US008245406B2

(12) United States Patent
Ali

(10) Patent No.: US 8,245,406 B2
(45) Date of Patent: Aug. 21, 2012

(54) ROLLING UTILITY KNIFE

(76) Inventor: Javid Ali, Mahomet, IL (US)

( * ) Notice: Subject to any disclaimer, the term of this patent is extended or adjusted under 35 U.S.C. 154(b) by 383 days.

(21) Appl. No.: 12/614,460

(22) Filed: Nov. 9, 2009

(65) Prior Publication Data

US 2011/0107607 A1 May 12, 2011

(51) Int. Cl.
*B26B 29/06* (2006.01)

(52) U.S. Cl. ..... 30/293; 30/286; 30/292; 30/294; 30/320

(58) Field of Classification Search ..... 30/286, 30/287, 292, 293, 294, 306, 307, 319, 320, 30/321, 371; 83/578, 614; 33/203.15, 435, 33/449, 527, 640, 27.12, 27.031, 27.032, 33/30.1, 30.6
See application file for complete search history.

(56) References Cited

U.S. PATENT DOCUMENTS

| | | | | | |
|---|---|---|---|---|---|
| 2,007,395 | A * | 7/1935 | Howard | 30/293 |
| 2,042,965 | A * | 6/1936 | Rivard | 30/123.3 |
| 2,555,142 | A * | 5/1951 | Levin | 30/320 |
| 2,758,650 | A * | 8/1956 | Lowens | 30/294 |
| 2,947,084 | A * | 8/1960 | Billings | 33/32.2 |
| 2,966,742 | A * | 1/1961 | Harian | 30/314 |
| 3,085,330 | A * | 4/1963 | Lewinski et al. | 30/293 |
| 3,094,026 | A * | 6/1963 | Pottle | 82/46 |
| 3,934,341 | A * | 1/1976 | Carlson | 30/287 |
| 4,286,384 | A * | 9/1981 | Kotchy | 30/287 |
| 4,310,198 | A * | 1/1982 | Destree | 299/39.3 |
| 4,527,750 | A * | 7/1985 | Juntti | 242/525.2 |
| 4,928,662 | A * | 5/1990 | Chiuminatta et al. | 125/13.01 |
| 5,485,676 | A * | 1/1996 | Terhorst | 30/294 |
| 5,715,605 | A * | 2/1998 | Nadeau | 30/293 |
| 5,815,929 | A * | 10/1998 | Ojea | 30/294 |
| 5,996,237 | A * | 12/1999 | Sanders | 33/42 |
| 6,430,817 | B2 * | 8/2002 | Hoffman | 30/293 |
| 7,591,072 | B2 * | 9/2009 | Stravitz | 30/50 |
| 2003/0115760 | A1 * | 6/2003 | Martinez | 30/294 |
| 2007/0108713 | A1 * | 5/2007 | Ali | 280/124.11 |
| 2011/0107607 | A1 * | 5/2011 | Ali | 30/315 |

* cited by examiner

*Primary Examiner* — Hwei C Payer
(74) *Attorney, Agent, or Firm* — McKinney Law, PLLC

(57) ABSTRACT

A rolling utility knife is disclosed. The rolling utility knife includes a pair of frame rails and at least one cross-member connecting the pair of frame rails. In addition, the rolling utility knife includes a front roller and a rear roller disposed between the frame rails. A circular blade is adapted to rotate along an outside edge of a first rail of the pair of frame rails. The rolling utility knife further includes a lever secured to an inside edge of the first rail by a fulcrum, where the circular blade secured to a first end of the lever and the blade is adjustable to move vertically relative to the first rail. A pin is disposed at a second end of the lever, where the pin is configured to cause the circular blade to move downward when the rolling utility knife is placed on a planar surface.

14 Claims, 3 Drawing Sheets

ROLLING UTILITY KNIFE

CROSS-REFERENCE TO RELATED APPLICATIONS

This application is a continuation-in-part of U.S. patent application Ser. No. 11/584,092 filed Oct. 20, 2006, now abandoned entitled "Rolling Utility Knife."

BACKGROUND

I. Field of the Invention

The present invention relates generally to utility knives, and more specifically to a novel carriage for a utility knife that provides for improved accuracy and consistency in cutting materials.

II. Background

Utility knives are used every day for general purposes such as cutting paper, cartons, packages, cloth, twine, and envelopes. The prior art utility knives are typically sufficient for making short cuts. However, construction workers use utility knives to cut dry wall, wall paper or carpet, for example, that requires relatively long straight consistent cuts. The failure to make a straight cut results in waste and poor workmanship.

Another shortcoming of the prior art utility knives is that the amount of pressure applied by an inexperienced user when making a cut is not consistent. This leads to either a cut that is too shallow and incomplete or a cut that is too deep and damages the underlying material. Accordingly, what is needed in the art is a utility knife that can apply constant pressure to the blade regardless of the user's skill.

There are numerous utility knives on the market today that are variations from the standard fixed blade utility knife. Continuing efforts are being made to improve utility knives. By way of example, note U.S. Pat. No. 4,868,985 to Rehm that discloses a utility knife that provides for a blade that extends out of the housing when beginning a cut and automatically retracts at the end of the cutting operation. Rehm is directed to the safety of a user and the device itself to avoid personal injuries. It is not directed to improved accuracy and consistency in cutting as the present invention.

U.S. Pat. No. 4,884,342 to McNamara et al. discloses a utility knife with a wheel that is displaced proximate to the blade. The wheel is used to guide the blade over the cutting surface. However, the aforementioned teachings do not provide a mechanism by which a user can make a long straight cut in the field of a planar material or is adaptable to be used with a variety of tools other than a knife.

Notwithstanding the existence of such prior art utility knives, there is a need for an improved utility knife that will provide improved accuracy and consistency in cutting to increase efficiency and reduce waste.

SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a rolling utility knife is disclosed. The rolling utility knife includes a pair of frame rails, at least one cross-member connecting the pair of frame rails, a front roller disposed between the frame rails proximate a front portion of the rolling utility knife and a rear roller disposed between the frame rails proximate a rear portion of the rolling utility knife. In addition, the rolling utility knife includes a circular blade adapted to rotate along an outside edge of a first rail of the pair of frame rails. A lever is secured to an inside edge of the first rail by a fulcrum, where the circular blade is secured to a first end of the lever and the blade is adjustable to move vertically relative to the first rail. Also, a pin is disposed at a second end of the lever, where the pin is configured to cause the circular blade to move downward when the rolling utility knife is placed on a planar surface. A slot may be disposed in the first rail, where the slot is configured to control the range of movement of the circular blade and a spring is configured to keep the circular blade in an up position when the utility rolling knife is not placed on the planar surface. A handle on the rolling utility knife is adapted to allow a user to push the rolling utility knife in a desired direction.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

DETAILED DESCRIPTION OF THE PREFERRED EMBODIMENT

The word "exemplary" is used herein to mean "serving as an example, instance, or illustration." Any embodiment or design described herein as "exemplary" is not necessarily to be construed as preferred or advantageous over other embodiments or designs.

Figure 1:
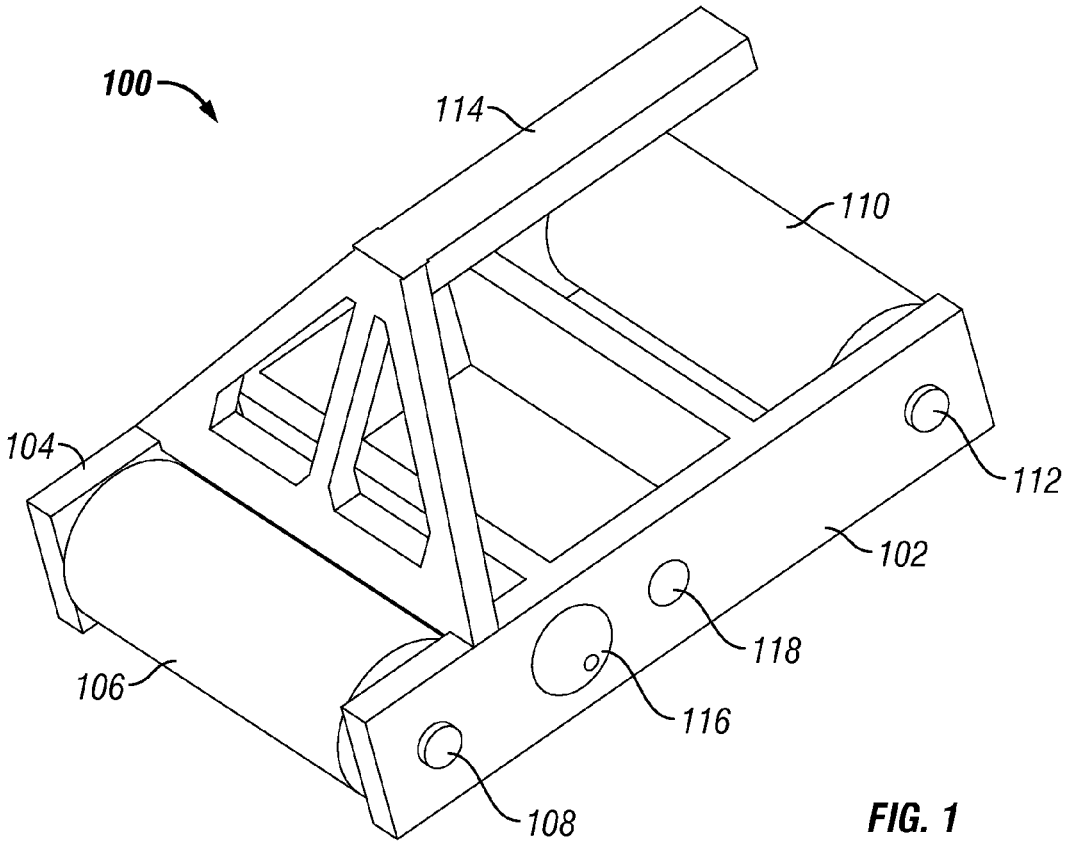
FIG. 1 is a perspective view of a particular embodiment of a rolling utility knife.

Referring to FIG. 1, a particular illustrative embodiment of a rolling utility knife 100 is disclosed. The knife 100 includes a pair of frame rails 102, 104. A front roller 106 is disposed between the pair of frame rails 102, 104 at a front portion of the knife 100. A rear roller 110 is disposed between the frame rails 102, 104 at a rear portion of the knife 100. A biasing means of the frame rails 102, 104 allows free rotation motion of each roller. For example, a pair of front apertures 108 may be configured to secure a respective end of the front roller 106 to each respective frame rail 102, 104. Similarly, a pair of rear apertures 112 may be configured to secure a respective end of the rear roller 112 to each respective frame rail 102, 104. A cross member may be used between the pair of frame rails 102, 104 to structurally strengthen the rolling utility knife 100. A circular blade 116 is adapted to rotate along an outside edge of a first rail 102. The blade 116 is positioned so that as the rolling utility knife 100 is moved forward, the blade 116 makes a cut or incision into a construction material (not shown). The knife 100 travels in straight-line motion and remains in alignment.

Figure 2:
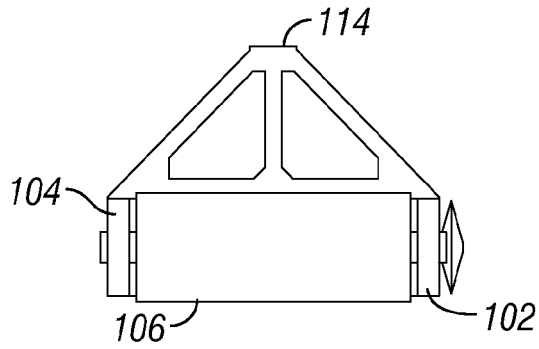
FIG. 2 is a front view of the rolling utility knife shown in FIG. 1.
Figure 3:
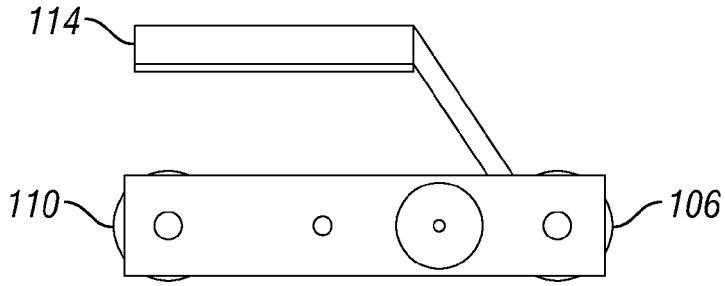
FIG. 3 is an elevational view of the rolling utility knife shown in FIG. 1.
Figure 4:
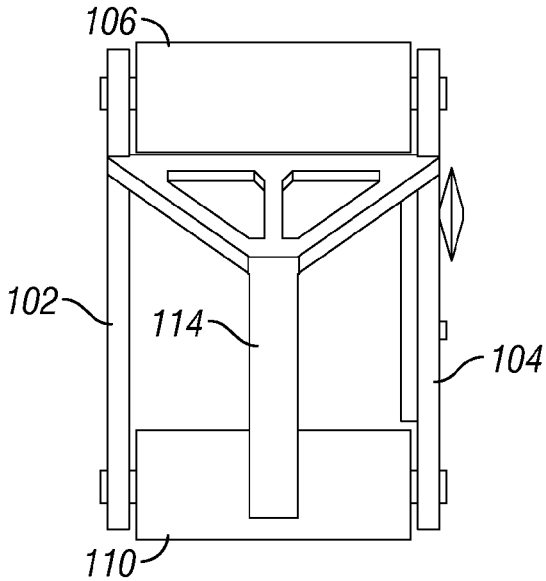
FIG. 4 is a top view of the rolling utility knife shown in FIG. 1.

Referring now to FIGS. 2-4, the front and rear rollers 106, 110 are constructed so that the rolling utility knife 100 cannot deviate from its desired path. The rolling utility knife 100 may be used within a track, independently, or with a straight edge. A handle 114 may be attached to the rolling utility knife 100. The position of the handle 114 allows the user to grip the handle 114 in an ergonomic fashion when moving the knife 100 forward (or backward).

Figure 5:
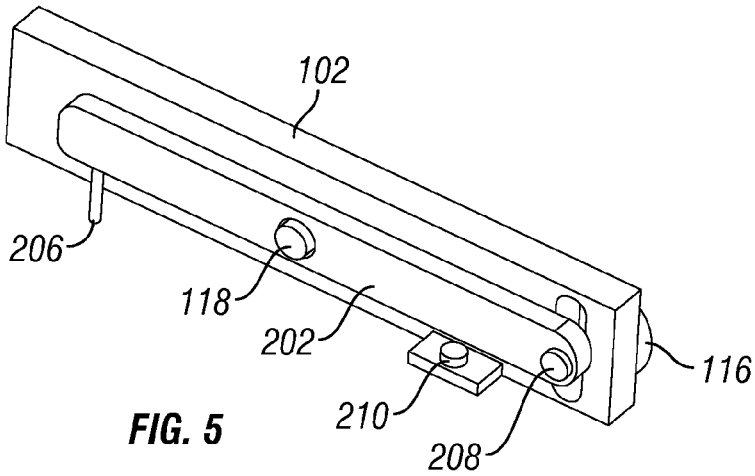
FIG. 5 is a perspective view of a cutting mechanism attached to an inside edge of the rolling utility knife.
Figure 6:
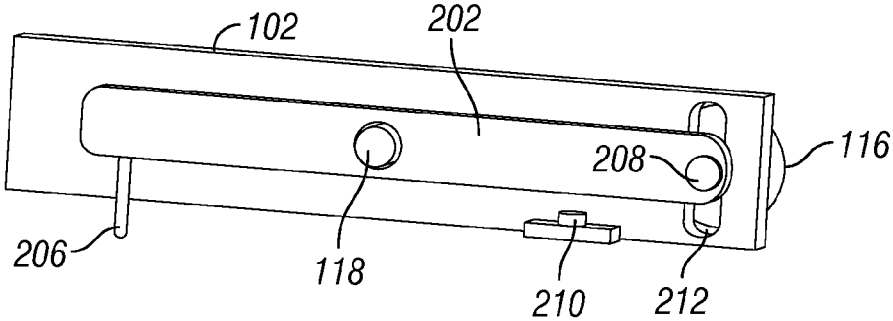
FIG. 6 is an elevational view of the cutting mechanism shown in FIG. 5.
Figure 7:
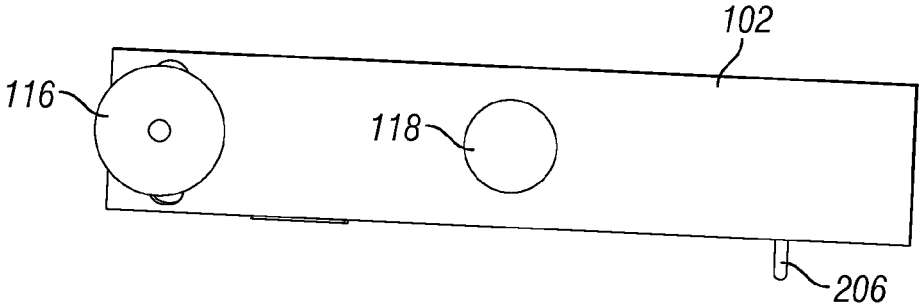
FIG. 7 is an opposing elevational view of the cutting mechanism shown in FIGS. 5-6 and attached to an outside edge of the rolling utility knife.

Referring now to FIGS. 5-7, a cutting mechanism of the rolling utility knife is illustrated. A lever 202 is secured to an inside edge of the first rail 102 by a fulcrum 118. The circular blade 116 is secured to a first end of the lever 202 and the blade 116 is adjustable to move vertically relative to the first rail 102. A pin 206 is disposed at a second end of the lever 202, where the pin 206 is configured to cause the blade 116 to move downward about the fulcrum 118 when the rolling utility knife 100 is placed on a planar surface. A slot 212 may also be disposed in the first rail, where the slot 212 is configured to control the range of movement of the circular blade 116. In addition, a spring 210 is configured to bias the blade 116 in the up position so that the blade 116 will not accidentally injure a person when not in use or placed on a planar surface. A blade axle 208 may be used to secure the circular blade 116 to the lever 202.

In an alternative embodiment, a laser device or other optical device may be attached to the rolling utility knife 100 to provide a visual aid to maintain the straight-line cutting motion of the blade 116. Various types of blades may be used with the rolling utility knife 100 and is not intended to be limited by the drawings. The rolling utility knife 100 may also be used with optional tools such as circular saws and rotozips, as well as angle grinders, routers, and sanders. The rolling utility knife 100 is adaptable for use with hand raspers, saws, chisels and other similar hand tools. Further, a writing instrument may be attached to one of the pair of rails 102, 104 to sketch straight lines on a desired material. An attachment means may include an adjustable bracket to secure an optional tool to the rolling utility knife 100.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.52(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A rolling utility knife comprising:

a pair of frame rails;

at least one cross-member connecting the pair of frame rails;

a front roller disposed between the frame rails proximate a front portion of the rolling utility knife;

a rear roller disposed between the frame rails proximate a rear portion of the rolling utility knife;

a circular blade adapted to rotate along an outside edge of a first rail of the pair of frame rails; and a lever secured to an inside edge of the first rail by a fulcrum, wherein the circular blade is secured to a first end of the lever and the blade is adjustable to move vertically relative to the first rail.

2. The rolling utility knife of claim 1, further comprising a pin disposed at a second end of the lever, wherein the pin is configured to cause the circular blade to move downward when the rolling utility knife is placed on a planar surface.

3. The rolling utility knife of claim 2, further comprising a slot disposed in the first rail, wherein the slot is configured to control the range of movement of the circular blade.

4. The rolling utility knife of claim 3, further comprising a spring configured to keep the circular blade in an up position when the utility rolling knife is not placed on the planar surface.

5. The rolling utility knife of claim 4, further comprising a handle, wherein the handle is adapted to allow a user to push the rolling utility knife in a desired direction.

6. The rolling utility knife of claim 5, further comprising a pair of front apertures, wherein each aperture of the pair of front apertures is configured to secure a respective end of the front roller to each respective frame rail of the pair of frame rails.

7. The rolling utility knife of claim 6, further comprising a pair of rear apertures, wherein each aperture of the pair of rear apertures is configured to secure a respective end of the rear roller to each respective frame rail of the pair of frame rails.

8. The rolling utility knife of claim 7, further comprising a blade axle, wherein the blade axle is adapted to secure the circular blade to the lever.

9. A rolling utility knife comprising:

a front roller disposed proximate a front portion of the rolling utility knife;

a rear roller disposed proximate a rear portion of the rolling utility knife;

a circular blade adapted to rotate along an outside edge of the rolling utility knife; and a lever secured to an inside edge of the rolling utility knife by a fulcrum, wherein the circular blade is secured to a first end of the lever and the blade is adjustable to move vertically relative to the rolling utility knife.

10. The rolling utility knife of claim 9, further comprising a pin disposed at a second end of the lever, wherein the pin is configured to cause the circular blade to move downward when the rolling utility knife is placed on a planar surface.

11. The rolling utility knife of claim 9, further comprising a slot, wherein the slot is configured to control the range of movement of the circular blade.

12. The rolling utility knife of claim 11, further comprising a spring configured to keep the circular blade in an up position when the utility rolling knife is not placed on the planar surface.

13. The rolling utility knife of claim 9, further comprising a handle, wherein the handle is adapted to allow a user to push the rolling utility knife in a desired direction.

14. The rolling utility knife of claim 9, further comprising a pair of frame rails, wherein the front roller and the rear roller are disposed between the pair of frame rails.

* * * * *